US005497793A

United States Patent [19]

Kubica

[11] Patent Number: 5,497,793

[45] Date of Patent: Mar. 12, 1996

[54] CIGARETTE AND SOLUBLE CIGARETTE FILTER THEREFOR

[76] Inventor: Stephen A. Kubica, 1653 S. Shore Dr., Holland, Mich. 49423

[21] Appl. No.: 125,403

[22] Filed: Sep. 22, 1993

[51] Int. Cl.[6] ..... A24D 3/00

[52] U.S. Cl. ..... 131/331; 131/340; 493/42

[58] Field of Search ..... 131/331, 340, 131/342; 493/39, 42, 43, 48

[56] References Cited

U.S. PATENT DOCUMENTS

| | | | |
|---|---|---|---|
| 2,804,874 | 9/1957 | Visnick | 131/331 X |
| 3,017,309 | 1/1962 | Crawford et al. . | |
| 3,219,041 | 11/1965 | Bromberg | 131/331 X |
| 4,038,992 | 8/1977 | Ogasa et al. . | |
| 4,863,655 | 9/1989 | Lacourse et al. . | |
| 4,896,683 | 1/1990 | Cohen et al. | 131/331 X |
| 4,924,887 | 5/1990 | Raker et al. | 131/331 |
| 5,035,930 | 7/1991 | Lacourse et al. . | |
| 5,043,196 | 8/1991 | Lacourse et al. . | |
| 5,076,294 | 12/1991 | Kramer | 131/331 |
| 5,153,037 | 10/1992 | Altieri . | |
| 5,161,549 | 11/1992 | Rosario | 131/331 |

OTHER PUBLICATIONS

"ECO–FOAM® Starch Based Loose Fill," American Excelsior Company, date unknown.

"Loose–fill an Environmentalist can Love," *Packaging Digest*, Apr. 1991, pp. 44 and 46.

"ECO–FOAM" Fact sheet, American Excelsior Company, Oct. 19, 1990.

ECO–FOAM Brochure, National Starch and Chemical Co., date unknown.

*Primary Examiner*—Jennifer Bahr

*Attorney, Agent, or Firm*—Varnum, Riddering, Schmidt & Howlett

[57] ABSTRACT

A filter cigarette includes a tobacco smoke filter having a core of an expanded starch material which is biodegradable and readily soluble in water. The filter material is preferably formed of high amylose content cornstarch or potato starch extruded at a moisture content of between 10% and 21% at a temperature between 150° to 250° C.

7 Claims, 2 Drawing Sheets

CIGARETTE AND SOLUBLE CIGARETTE FILTER THEREFOR

BACKGROUND OF THE INVENTION

1. Field of the Invention

This invention relates to a filter cigarette, and more specifically to a filter cigarette having a filter composed of water soluble biodegradable material and to a water soluble filter therefor.

2. State of the Prior Art

Most smokers prefer to smoke cigarettes having a cigarette filter. The cigarette filter tends to cool the cigarette smoke, thereby creating a more pleasant smoking experience. Also, the cigarette filter may remove a portion of the more noxious components of the smoke, thereby creating a somewhat healthier smoking experience.

Commonly, cigarette filters comprise a core of water insoluble filtering material, such as bonded cellulose acetate tow. Typically, the filter comprises a short cylindrical plug of the filter material which is rolled along with the tobacco in the cigarette paper to form a completed cigarette. However, the filter may be separately wrapped in paper, and then attached to the end of the cigarette.

There is little doubt that littering is a significant problem. Some smokers discard spent cigarettes in public places. Of course, a burning cigarette may not be simply tossed into a garbage can, as it poses a combustion hazard. When out of doors, smokers may throw their spent, yet still burning, cigarette butt to the ground. Typically, the smoker extinguishes combustion of the cigarette by stepping on the cigarette butt, thereby cutting off its supply of oxygen. Commonly, the extinguished cigarette butt, or even a still smoldering cigarette butt, is simply left upon the ground. Some inconsiderate drivers empty their automobile ashtrays on roadways and in public parking lots, thereby littering public areas.

The filter material of most of today's cigarettes requires a long time to decompose in the environment. Of all the cigarette components, the filter material is typically the last to degrade. In areas frequented by smokers, such as building entrances, spent cigarette butts tend to accumulate, creating an unsightly mess.

SUMMARY OF THE INVENTION

According to the invention, a cigarette filter is formed of a readily biodegradable material which readily dissolves in water. The cigarette according to the invention comprises an outer paper wrapping forming an elongate tube having a forward portion and a rear portion. The forward portion of the tube contains smokable tobacco, and the rearward portion of the tube contains a filter. The filter comprises a readily water soluble expanded organic material.

Preferably, the organic material is cornstarch or potato starch. Also preferably, the starch has an amylose content of at least 40% by weight. The material of the filter is formed by extruding the starch in the presence of a moisture content of 21% or less by weight at a temperature of from about 150° to 250° centigrade. To prevent a smoker from contacting the filter with his or her tongue, the filter is preferably recessed within the outer paper wrapping. The portion of the paper surrounding the filter can be thinner than a portion of the paper which surrounds the tobacco.

DETAILED DESCRIPTION OF THE DRAWING

Figure 1:
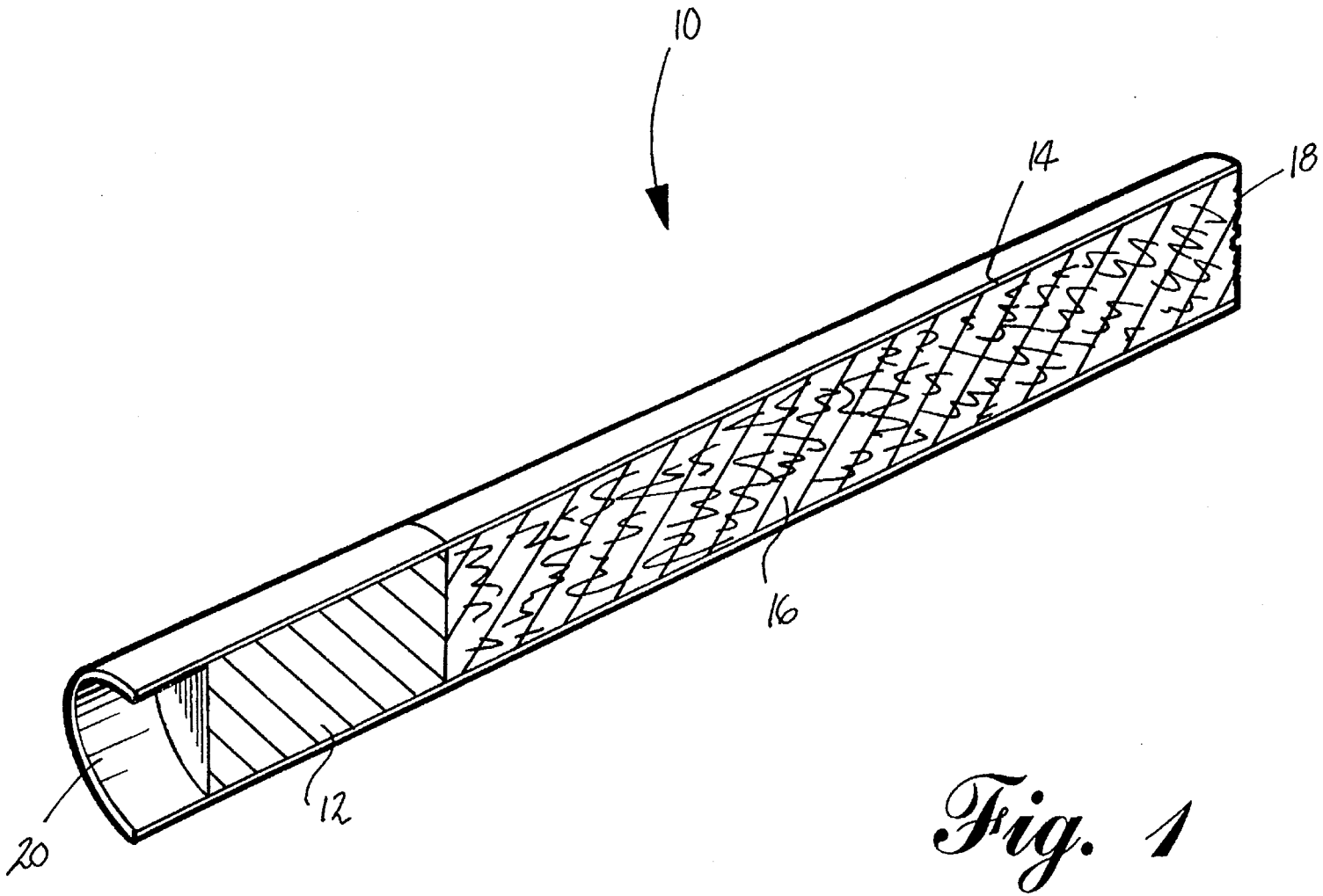
FIG. 1 shows a side elevation view in section of a cigarette having a filter according to the invention.

FIG. 1 illustrates the cigarette 10 incorporating a filter 12 according to the invention. The cigarette 10 is formed of an elongated cylindrical tube of cigarette paper 14 filled with tobacco 16 at a forward end 18, and having the filter 12 at a rearward end 20. The filter 12 is recessed from the rearward end 20.

Figure 2:
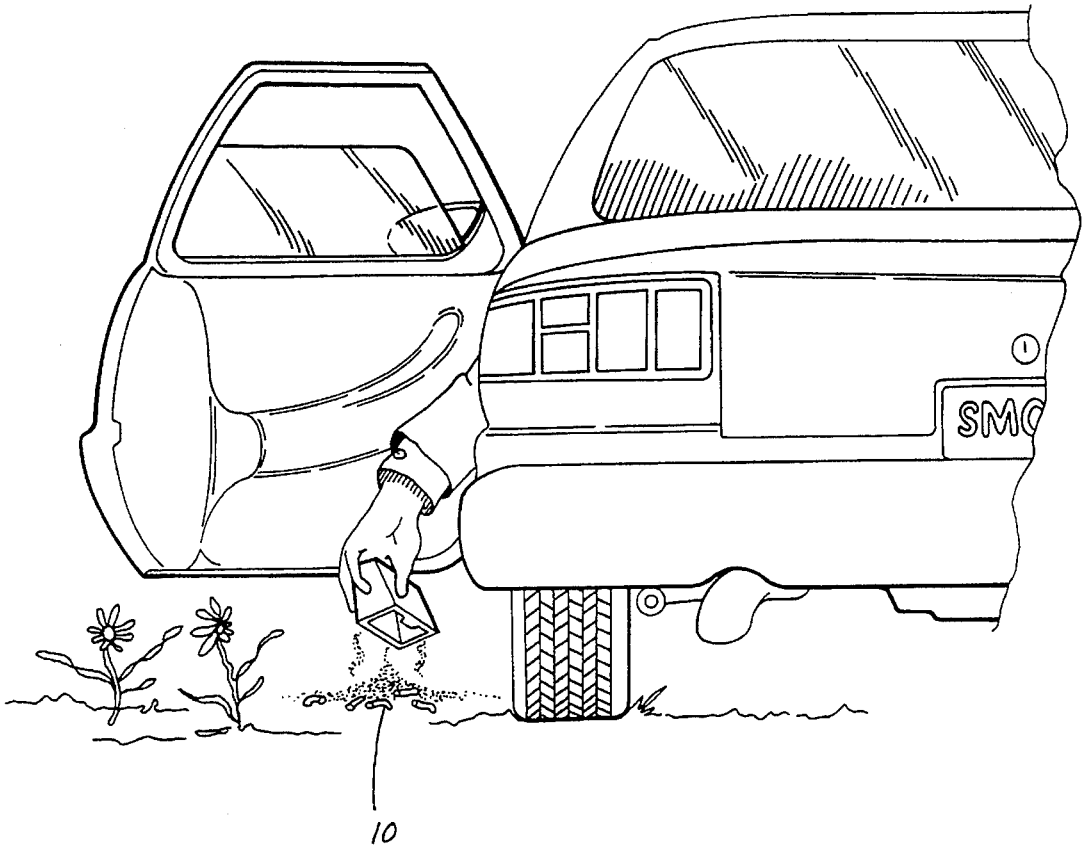
FIG. 2 illustrates an all too common spent cigarette disposal technique.

The filter 12 comprises a foamed organic readily water soluble material. If, during its lifetime, the filter 12 encounters the unfortunate situation illustrated in FIG. 2, it will dissolve in the first rain.

Preferably, the filter is formed by expanding a high amylose starch material, such as cornstarch having at least 45% by weight amylose content, through an extruder in the presence of a total moisture content of from about 10% to 21% by weight, at a temperature of from 150° to 250° C. An example of such material is Eco-Foam distributed by the American Excelsior Company, Box 5067, 850 Avenue H East, Arlington, Tex. 76005. The details for forming such a material are disclosed in U.S. Pat. No. 4,863,655, issued on Sep. 5, 1989, entitled "Biodegradable Packaging Material and the Method of Preparation Thereof," and in related U.S. Pat. No. 5,153,037, issued on Oct. 6, 1992, entitled "Biodegradable Shaped Products and the Method of Preparation Thereof," both of which patents are incorporated herein by reference. Preferably, the filter 12 is formed of a hybrid corn having at least 45% amylose content, contains 5% water soluble polyvinyl alcohol, and conforms to FDA food contact specifications.

Alternatively, the filter can be made of other foamed water soluble material, such as foamed potato starch made in a manner similar to the foamed cornstarch.

The filter 12 preferably has a low density, a high resiliency and a high compressibility. Other high amylose starches including potato starch are suitable substitutes for the high amylose cornstarch. The high amylose cornstarch has a closed cell foam structure. Alternatively, lower amylose cornstarch which produces an open celled foam having a greatly decreased compressibility can be used in the filter construction according to the invention.

The filter 12 preferably comprises a short cylindrical plug of the expanded organic foam material. The filter 12 can be wrapped into the cigarette 10 like a conventional filter, or compressed and inserted into a pre-rolled cigarette. Preferably, the filter 12 is recessed a small distance, for example, one eight inch to one quarter inch from the cigarette rear end 20, to prevent the smoker from direct contact with, and possible premature dissolving of, the filter. Also, the paper 14 around the filter can be thinner than normal to promote more rapid deterioration of the paper 14 after the filter 12 dissolves from inside of it.

The filter 12 of the present invention provides a significant environmental advantage over previously available cigarette filters. Compared to conventional cigarette filter material, which decomposes slowly at best, the filter 12 of the present invention decomposes rapidly upon saturation with water. For example, a cornstarch filter made in accordance with the invention dissolves within several minutes after being saturated with water. It is nontoxic, will help eliminate the piles of filters at building entrances, streets, beaches, and in water ways, and will also dissolve and flush down drains without clogging. The filter 12 of the present invention can also be applied to filter tipped cigars and other tobacco products.

While particular embodiments of the invention have been shown, it will be understood, of course, that the invention is not limited thereto since modifications can be made by those skilled in the art, particular in light of the foregoing teachings. Reasonable variation and modification are possible within the foregoing disclosure of the invention without departing from the spirit of the invention.

The embodiments of the invention in which an exclusive property or privilege is claimed are defined as follows:

1. A cigarette comprising an outer paper wrapping forming an elongated tube having a forward portion and a rearward portion, the forward portion of the tube containing smokable tobacco, and the rearward portion of the tube containing a filter, the filter consisting essentially of a porous body formed of a readily water soluble, expanded organic starch material of corn or potato.

2. A cigarette according the claim 1 wherein the starch has an amylose content of at least 40% by weight.

3. A cigarette according to claim 2 wherein the material of the filter can be formed by extruding the starch in the presence of a moisture content of 21% or less by weight at a temperature of from about 150° to 250° centigrade.

4. A cigarette according to claim 1 wherein the filter is recessed within the outer paper wrapping whereby the outer paper wrapping extends proximal of the filter to prevent a smoker from contacting the filter with his or her tongue.

5. A cigarette according to claim 1 wherein the filter porous body is unitary in construction.

6. A cigarette comprising an outer paper wrapping forming an elongated tube having a forward portion and a rearward portion, the forward portion of the tube containing smokable tobacco, and the rearward portion of the tube containing a filter, the filter consisting essentially of a porous body formed of a readily water soluble expanded organic starch material and a portion of the paper surrounds the filter and is thinner than a portion of the paper which surrounds the tobacco.

7. A cigarette comprising an outer paper wrapping forming an elongated tube having a forward portion and a rearward portion, the forward portion of the tube containing smokable tobacco, and the rearward portion of the tube containing a filter, the filter comprising a readily water soluble, expanded organic corn or potato starch having an amylose content of at least 40% by weight and can be formed by extruding the starch in the presence of a moisture content of 21% or less by weight at a temperature from about 150° to 250° C.

* * * * *